US009466309B2

(12) United States Patent
Huang et al.

(10) Patent No.: US 9,466,309 B2
(45) Date of Patent: Oct. 11, 2016

(54) METHOD AND DEVICE FOR PROCESSING AUDIO SIGNAL

(71) Applicant: ASUSTeK COMPUTER INC., Taipei (TW)

(72) Inventors: Lai-Shi Huang, Taipei (TW); Chien-Ho Wu, Taipei (TW)

(73) Assignee: ASUSTeK COMPUTER INC., Taipei (TW)

( * ) Notice: Subject to any disclaimer, the term of this patent is extended or adjusted under 35 U.S.C. 154(b) by 142 days.

(21) Appl. No.: 14/556,241

(22) Filed: Dec. 1, 2014

(65) Prior Publication Data

US 2015/0194164 A1 Jul. 9, 2015

(30) Foreign Application Priority Data

Jan. 9, 2014 (CN) ..... 2014 1 0010418

(51) Int. Cl.

| | |
|---|---|
| ***G10L 25/90*** | (2013.01) |
| ***H04R 3/04*** | (2006.01) |
| ***G10L 19/26*** | (2013.01) |
| ***G10L 25/48*** | (2013.01) |
| ***G10H 1/12*** | (2006.01) |

(52) U.S. Cl.

CPC ..... *G10L 19/26* (2013.01); *G10H 1/125* (2013.01); *G10L 25/48* (2013.01); *H04R 3/04* (2013.01); *G10L 25/90* (2013.01)

(58) Field of Classification Search

CPC ..... G10L 25/90; G10H 1/125; H04R 3/04
USPC ..... 704/205, 226; 381/94.2, 94.3
See application file for complete search history.

(56) References Cited

U.S. PATENT DOCUMENTS

| | | | | |
|---|---|---|---|---|
| 4,608,903 | A * | 9/1986 | Deutsch | G10H 7/105 84/607 |
| 6,154,550 | A * | 11/2000 | Beyer | H03G 3/301 381/108 |
| 8,073,148 | B2 * | 12/2011 | Kim | G10L 21/0208 381/71.1 |
| 8,213,598 | B2 * | 7/2012 | Bendersky | H04M 9/082 381/93 |
| 2008/0281589 | A1 * | 11/2008 | Wang | G10L 21/0208 704/226 |
| 2009/0216353 | A1 * | 8/2009 | Van Reck | H04R 3/04 700/94 |
| 2009/0323983 | A1 * | 12/2009 | De Muynke | H04R 3/04 381/98 |
| 2012/0136655 | A1 * | 5/2012 | Yamabe | G10L 25/90 704/207 |

(Continued)

FOREIGN PATENT DOCUMENTS

| | | |
|---|---|---|
| CN | 102957988 A | 3/2013 |
| CN | 103081356 A | 5/2013 |

*Primary Examiner* — Martin Lerner
(74) *Attorney, Agent, or Firm* — CKC & Partners Co., Ltd.

(57) ABSTRACT

An audio signal processing method includes following steps: playing a fundamental frequency signal by a media player; calculating a first fundamental frequency sound pressure value and a first harmonic sound pressure value of the fundamental frequency signal, and calculating a second fundamental frequency sound pressure value and a second harmonic sound pressure value of the audio signal; calculating a threshold sound pressure value according to the first fundamental frequency sound pressure value, the first harmonic sound pressure value, and the second fundamental frequency sound pressure value; and comparing the second harmonic sound pressure value and the threshold sound pressure value to generate a comparing result, and adjusting the second harmonic sound pressure value according to the comparing result. An audio signal processing device is also disclosed.

10 Claims, 5 Drawing Sheets

200

(56) References Cited

U.S. PATENT DOCUMENTS

2012/0243705 A1* 9/2012 Bradley ..... G10L 19/00 381/94.4
2013/0051581 A1 2/2013 Kawano
2013/0142360 A1* 6/2013 Potard ..... H03G 9/18 381/98
2014/0321666 A1* 10/2014 Bithell ..... H04R 3/002 381/94.1
2015/0244340 A1* 8/2015 Lee ..... H03H 7/12 333/174

* cited by examiner

200

METHOD AND DEVICE FOR PROCESSING AUDIO SIGNAL

CROSS-REFERENCE TO RELATED APPLICATION

This application claims the priority benefit of CN application serial No. 201410010418.0 filed on Jan. 9, 2014. The entirety of the above-mentioned patent application is hereby incorporated by reference herein and made a part of specification.

BACKGROUND OF THE INVENTION

1. Field of the Invention

The invention relates to a signal processing method and a signal processing device and, more particularly, to an audio signal processing method and an audio signal processing device.

2. Description of the Related Art

In a media player, the audio signal is usually processed by multiple electronic elements and generates new harmonics. However, a signal distortion happens when the harmonics applies to the original signal which is unpleasant to listeners.

BRIEF SUMMARY OF THE INVENTION

An audio signal processing method is provided. The method includes following steps: playing a fundamental frequency signal by a media player; calculating a first fundamental frequency sound pressure value and a first harmonic sound pressure value of the fundamental frequency signal, and calculating a second fundamental frequency sound pressure value and a second harmonic sound pressure value of the audio signal; calculating a threshold sound pressure value according to the first fundamental frequency sound pressure value, the first harmonic sound pressure value, and the second fundamental frequency sound pressure value; and comparing the second harmonic sound pressure value and the threshold sound pressure value to generate a comparing result, and adjusting the second harmonic sound pressure value according to the comparing result.

An audio signal processing device is also provided. The device for processing audio signal includes a calculator, a control unit and a filter. The calculator calculates a first fundamental frequency sound pressure value and a first harmonic sound pressure value of a fundamental frequency signal according to the fundamental frequency signal played by a media player. The calculator further calculates a second fundamental frequency sound pressure value and a second harmonic sound pressure value of the audio signal, and calculates a threshold sound pressure value according to the first fundamental frequency sound pressure value, the first harmonic sound pressure value and the second fundamental frequency sound pressure value. The control unit compares the second harmonic sound pressure value and the threshold sound pressure value to generate a comparing result, and the filter adjusts the second harmonic sound pressure value according to the comparing result.

Consequently, the method and the audio signal processing device can solve the problem that when the audio signal is processed by the media player, a harmonic is generated and added to the fundamental frequency signal of the media player, and the music distorts.

These and other features, aspects and advantages of the present invention will become better understood with regard to the following description, appended claims, and accompanying drawings.

DETAILED DESCRIPTION OF THE EMBODIMENTS

The meanings of scientific and technical words are the same as those used by persons having ordinary skills in the art, unless they are specially defined in the specification. Moreover, unless conflicting with the context, a singular noun used in the specification covers its plural forms, and plural nouns also cover the singular form.

The words "coupling" or "connecting" in the specification mean that two or more elements contact with each other physically or electrically, directly or indirectly, and they also mean that two or more elements cooperate or interact with each other.

Figure 1:
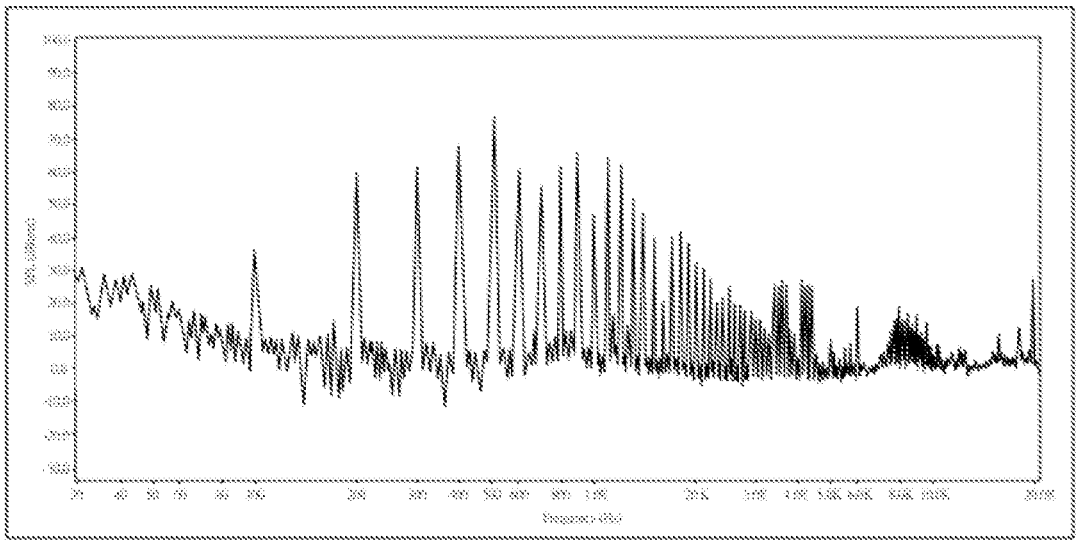
FIG. 1 is a spectrogram showing a played audio signal.

In order to make the concept of a fundamental frequency and a harmonic of an audio signal easy to be understood, FIG. 1 is a spectrogram showing a played audio signal. As shown in FIG. 1, the frequencies 100 Hz, 200 Hz, 300 Hz, 400 Hz and 500 Hz are fundamental frequency signals. There are also signals above 500 Hz, and the signals are harmonic signals. Once the harmonics are added to the original signals, music played by a media player distorts. Thus, an audio signal processing method and an audio signal processing device are provided to solve the music distortion problem, and they are illustrated in detail in the following.

Figure 2:
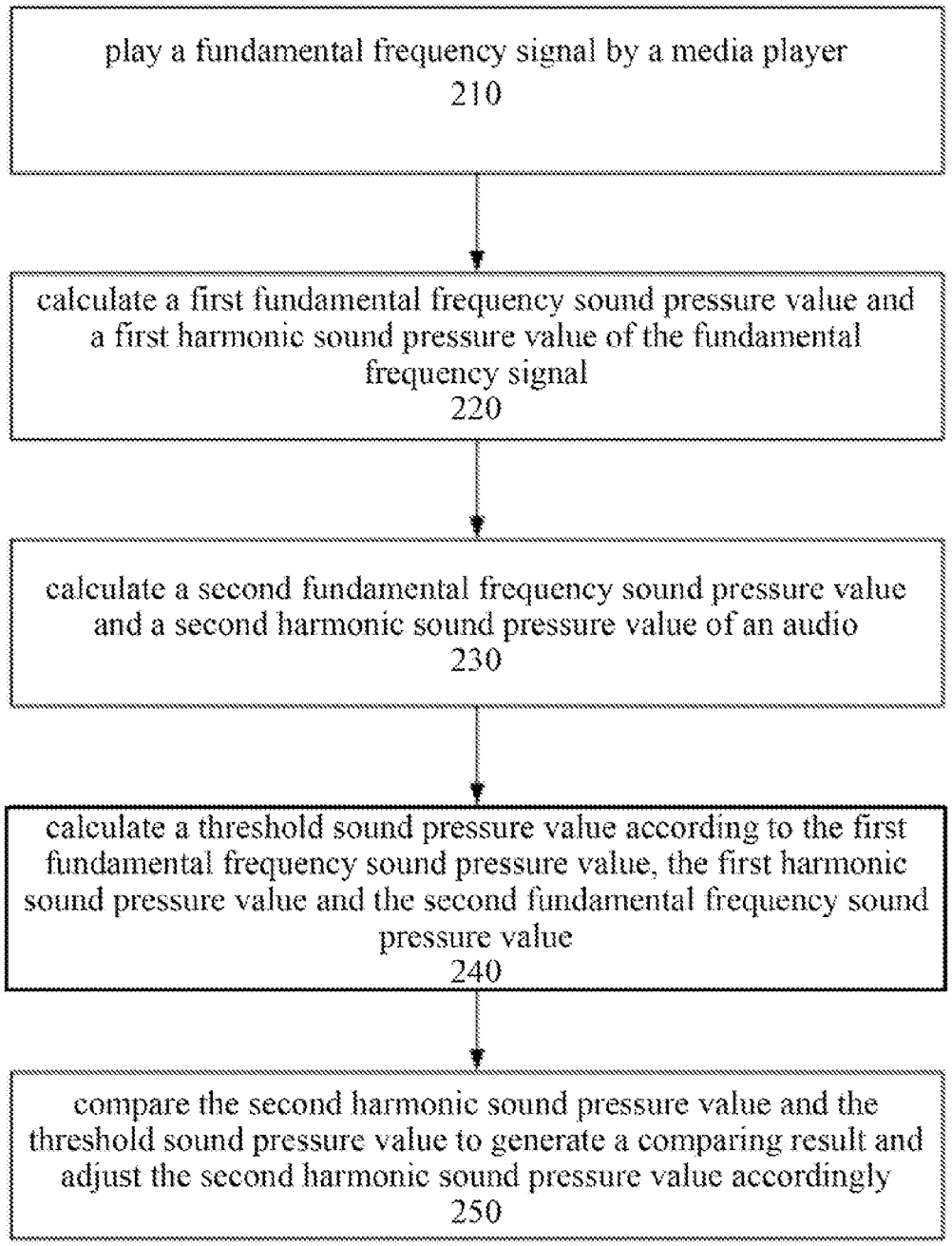
FIG. 2 is a flow chart showing an audio signal processing method in an embodiment.

FIG. 2 is a flow chart showing a method 200 for processing an audio signal in an embodiment. The method for processing audio signal 200 includes following steps:

step 210: playing a fundamental frequency signal by a media player;

step 220: calculating a first fundamental frequency sound pressure value and a first harmonic sound pressure value of the fundamental frequency signal;

step 230: calculating a second fundamental frequency sound pressure value and a second harmonic sound pressure value of an audio signal;

step 240: calculating a threshold sound pressure value according to the first fundamental frequency sound pressure value, the first harmonic sound pressure value and the second fundamental frequency sound pressure value; and step 250: comparing the second harmonic sound pressure value and the threshold sound pressure value to generate a comparing result and adjusting the second harmonic sound pressure value according to the comparing result.

Figure 3A:
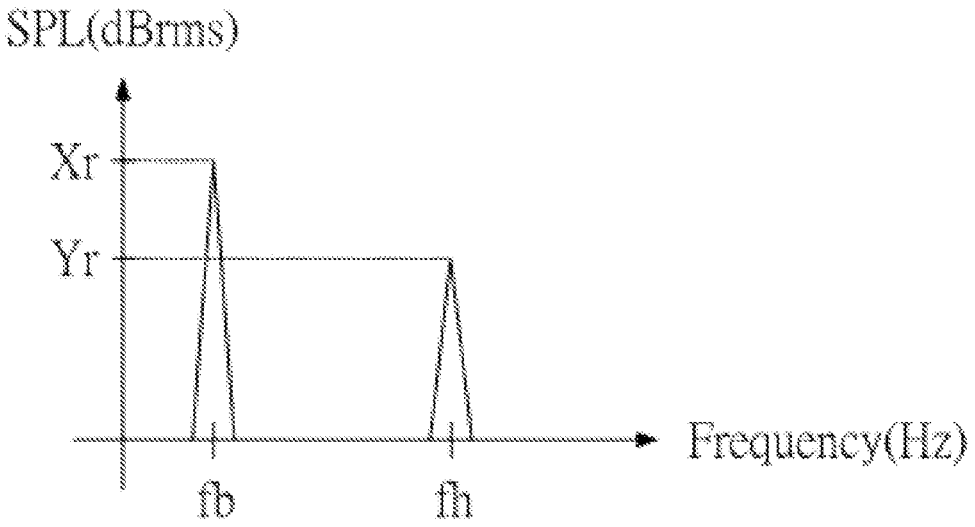
FIG. 3A is a schematic diagram showing a fundamental frequency signal played by a media player in an embodiment.
Figure 3B:
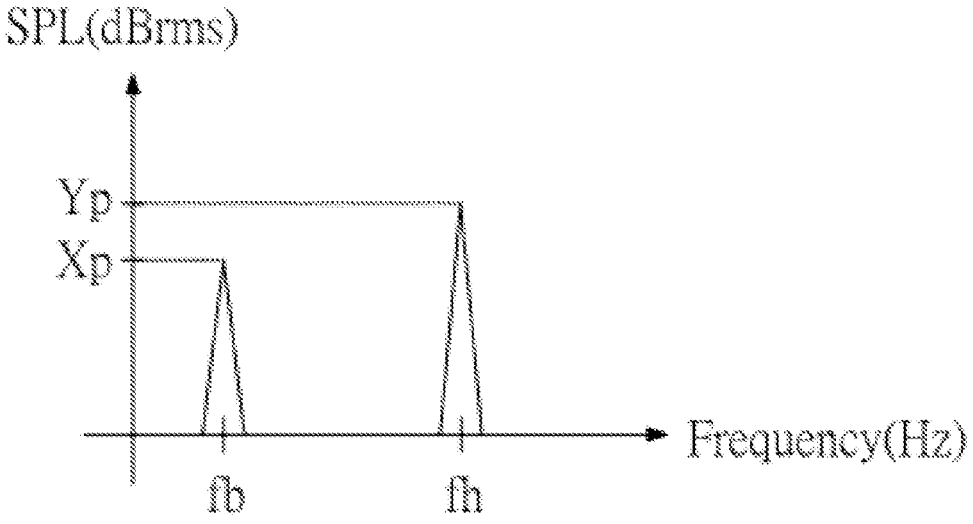
FIG. 3B is a schematic diagram showing a fundamental frequency and a harmonic of an audio signal in another embodiment.

In order to make the method 200 easy to be understood, please refer to FIG. 2. FIG. 3A and FIG. 3B. FIG. 3A is a schematic diagram showing a fundamental frequency signal played by a media player in an embodiment, and FIG. 3B is a schematic diagram showing a fundamental frequency and a harmonic of an audio signal in another embodiment.

Please refer to the step 210, the media player plays the fundamental frequency signal. Then, after the calculation in the step 220, the first fundamental frequency sound pressure value (Sound Pressure Value, SPL) Xr and the first harmonic sound pressure value Yr of the fundamental frequency signal are obtained, as shown in FIG. 3A. The first fundamental frequency sound pressure value Xr is the sound pressure value at the frequency fb, and the first harmonic sound pressure value Yr is the sound pressure value at the frequency fh. Similarly, after the calculation in the step 230, the second fundamental frequency sound pressure value Xp and the second harmonic sound pressure value Yp of the audio signal are obtained, as shown in FIG. 3B. The second fundamental frequency sound pressure value Xp is the sound pressure value at the frequency fb, and the second harmonic sound pressure value Yp is the sound pressure value at the frequency fh.

After the second harmonic sound pressure value Yp of the audio signal is obtained, in order to avoid a distortion of the music played by the media player when the second harmonic sound pressure value Yp is added to the fundamental frequency signal, a prevention mechanism is illustrated, in detail with the steps 240 and 250.

Please refer to the step 240, the threshold sound pressure value Ys is calculated according to the first fundamental frequency sound pressure value Xr, the first harmonic sound pressure value Yr and the second fundamental frequency sound pressure value Xp. The threshold sound pressure value Ys is used to compare with the second harmonic sound pressure value Yp. Then, in the step 250, the second harmonic sound pressure value Yp and the threshold sound pressure value Ys are compared to generate a comparing result. The second harmonic sound pressure value Yp is adjusted according to the comparing, result, so as to ensure that the adjusted second harmonic sound pressure value Yp is within an appropriate range.

Since in the step 240 of the method 200, the threshold sound pressure value Ys is obtained and the second harmonic sound pressure value Yp is adjusted according to the threshold sound pressure value Ys, it can ensure that the adjusted second harmonic sound pressure value Yp is within an appropriate range. Thus, when the adjusted second harmonic sound pressure value Yp is added to the fundamental frequency signal played by the media player, the signal would not exceed the output limit of the media player, and the music played by the media player keeps stable and distortion or overdrive would not happen.

The calculation of the threshold sound pressure value Ys is illustrated as follows. Please refer to the step 240, when the first fundamental frequency sound pressure value Xr equals to the second fundamental frequency sound pressure value Xp, which means when the first fundamental frequency sound pressure value Xr is adjusted to be the same as the second fundamental frequency sound pressure value Xp, the threshold sound pressure value Ys is obtained according to a ratio of the first fundamental frequency sound pressure value Xr and the first harmonic sound pressure value Yr. Furthermore, a calculation formula of the threshold sound pressure value Ys is:

$$Ys = Xp \times \frac{Yr}{Xr} \quad \text{(Formula 1)}$$

As shown in formula 1, the second fundamental frequency sound pressure value Xp is multiplied by the ratio of the first harmonic sound pressure value Yr and the first fundamental frequency sound pressure value Xr, and the threshold sound pressure value Ys is obtained.

In the step 250, if the comparing result is that the second harmonic sound pressure value Yp is larger than the threshold sound pressure value Ys when the media player plays the audio signal once a harmonic (such as the second harmonic) generated by the second fundamental frequency sound pressure value Xp is added to the fundamental frequency signal of the media player, the music played by the media player distorts and overdrives. Consequently, under this state, the harmonic sound pressure value (such as the second harmonic sound pressure value Yp) generated by the second fundamental frequency sound pressure value Xp needs to be reduced, and then even though the reduced second harmonic sound pressure value Yp is added to the fundamental frequency signal of the media player, the music played by the media player would not distort and overdrive.

In another embodiment, the method 200 further includes a step to calculate a sound pressure value correction for the adjustment of the second harmonic sound pressure value Yp in the step 250. If the second harmonic sound pressure value Yp is adjusted according to the sound pressure value correction, the adjustment is more precise and the music played by the media player would not distort or overdrive. The calculation formula of the sound pressure value correction is:

$$Ym = 20 \times \log_{10}\left(10^{\left(\frac{Yp}{20}\right)} - 10^{\left(\frac{Ys}{20}\right)}\right) \quad \text{(Formula 2)}$$

As shown in formula 2, Ym is the sound pressure value correction, and the sound pressure value correction Ym is calculated according to the second harmonic sound pressure value Yp and the threshold sound pressure value Ys. After the sound pressure value correction Ym is obtained, the second harmonic sound pressure value Yp is reduced to the sound pressure value correction Ym, which means the threshold sound pressure value Ys is subtracted from the second harmonic sound pressure value Yp. Thus, the adjusted second harmonic sound pressure value Yp (its value is already reduced to the sound pressure value correction Ym) is more precise and it can ensure that the music played by the media player would not distort or overdrive.

Figure 4:
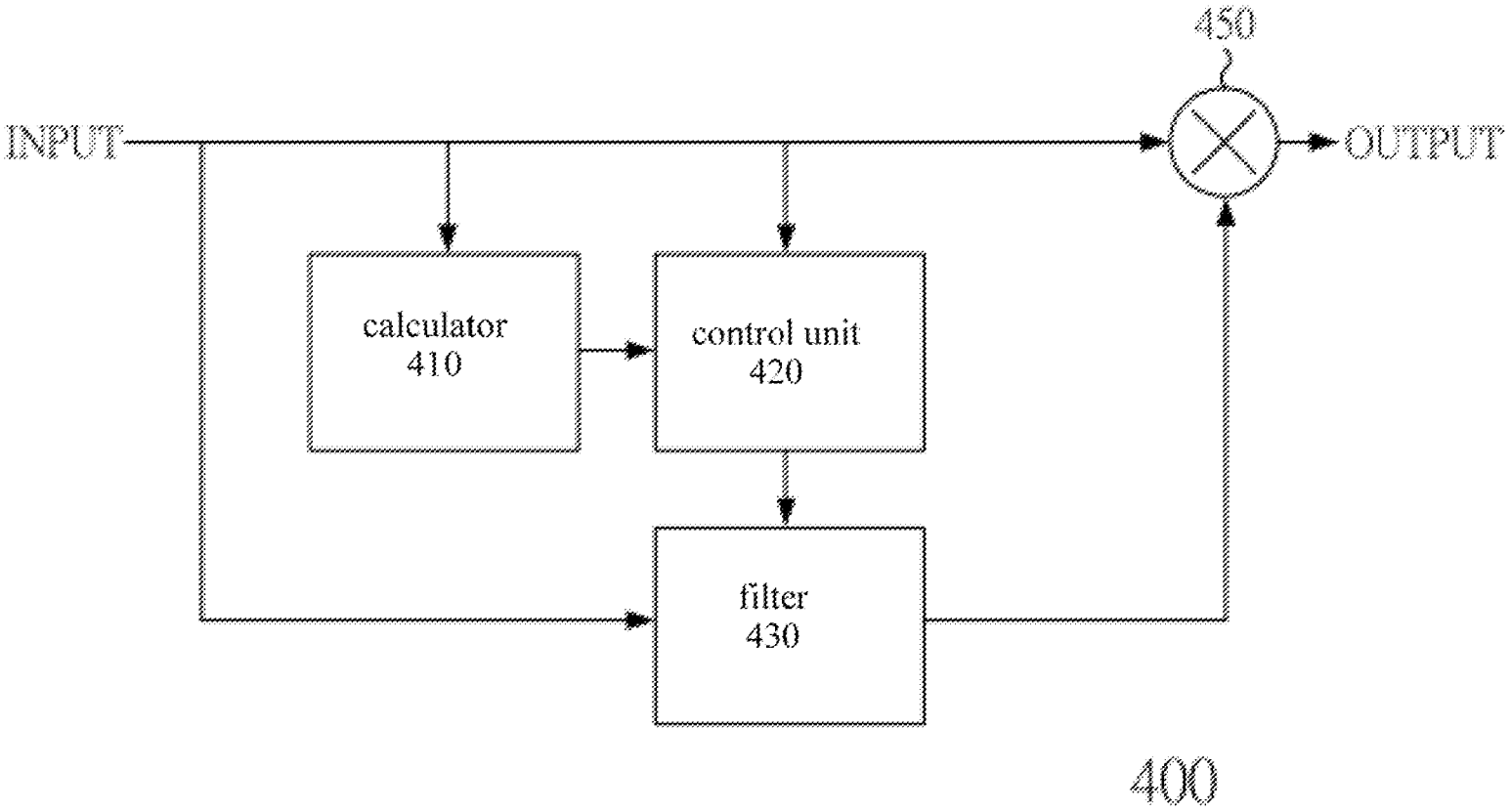
FIG. 4 is a schematic diagram showing an audio signal processing device in an embodiment.

FIG. 4 is a schematic diagram showing a device 400 for processing an audio signal in an embodiment. As shown in FIG. 4, the device 400 for processing an audio signal includes a calculator 410, a control unit 420, a filter 430 and a logic calculator 450. The control unit 420 is coupled to the calculator 410, and the filter 430 is coupled to the control unit 420 and the logic calculator 450. The device 400 for processing, an audio signal executes the steps of the method 200 in FIG. 2, which is illustrated in detail as follows.

The calculator 410 can execute the steps 220, 230 and 240. In detail, the calculator 410 receives an inputted audio signal, and calculates the second fundamental frequency sound pressure value Xp and the second harmonic sound pressure value Yp of the audio signal.

Moreover, the calculator 410 can obtain a frequency spectrum of the fundamental frequency signal played by the media player via a measuring device, calculates the first fundamental frequency sound pressure value Xr and the first harmonic sound pressure value Yr accordingly, and calculates the threshold sound pressure value Ys according to the first fundamental frequency sound pressure value Xr, the first harmonic sound pressure value Yr and the second fundamental frequency sound pressure value Xp. The calculation of the threshold sound pressure value Ys is already illustrated in the step 240, which is omitted herein for a concise purpose.

The control unit 420 and the filter 430 can execute the step 250. In detail, the control unit 420 compares the second harmonic sound pressure value Yp and the threshold sound pressure value Ys to generate the comparing result. Then, the filter 430 adjusts the second harmonic sound pressure value Yp according to the comparing result.

Furthermore, the filter 430 outputs a filtering signal according to the comparing result outputted by the control unit 420, and the logic calculator 450 calculates the inputted audio signal and the filtering signal to generate an outputted audio signal. For example, when the filtering signal is negative, the inputted audio signal is reduced after it is calculated by the logic calculator 450, especially, the second harmonic sound pressure value Yp of the inputted audio signal is reduced. Consequently, the second harmonic sound pressure value Yp of the inputted audio signal is within an appropriate range, and after the adjusted second harmonic sound pressure value Yp is added to the fundamental frequency signal played by the media player, the signal would not exceed the output limit of the media player. Thus, the music played by the media player keeps stable and distortion or overdrive would not happen.

Figure 5:
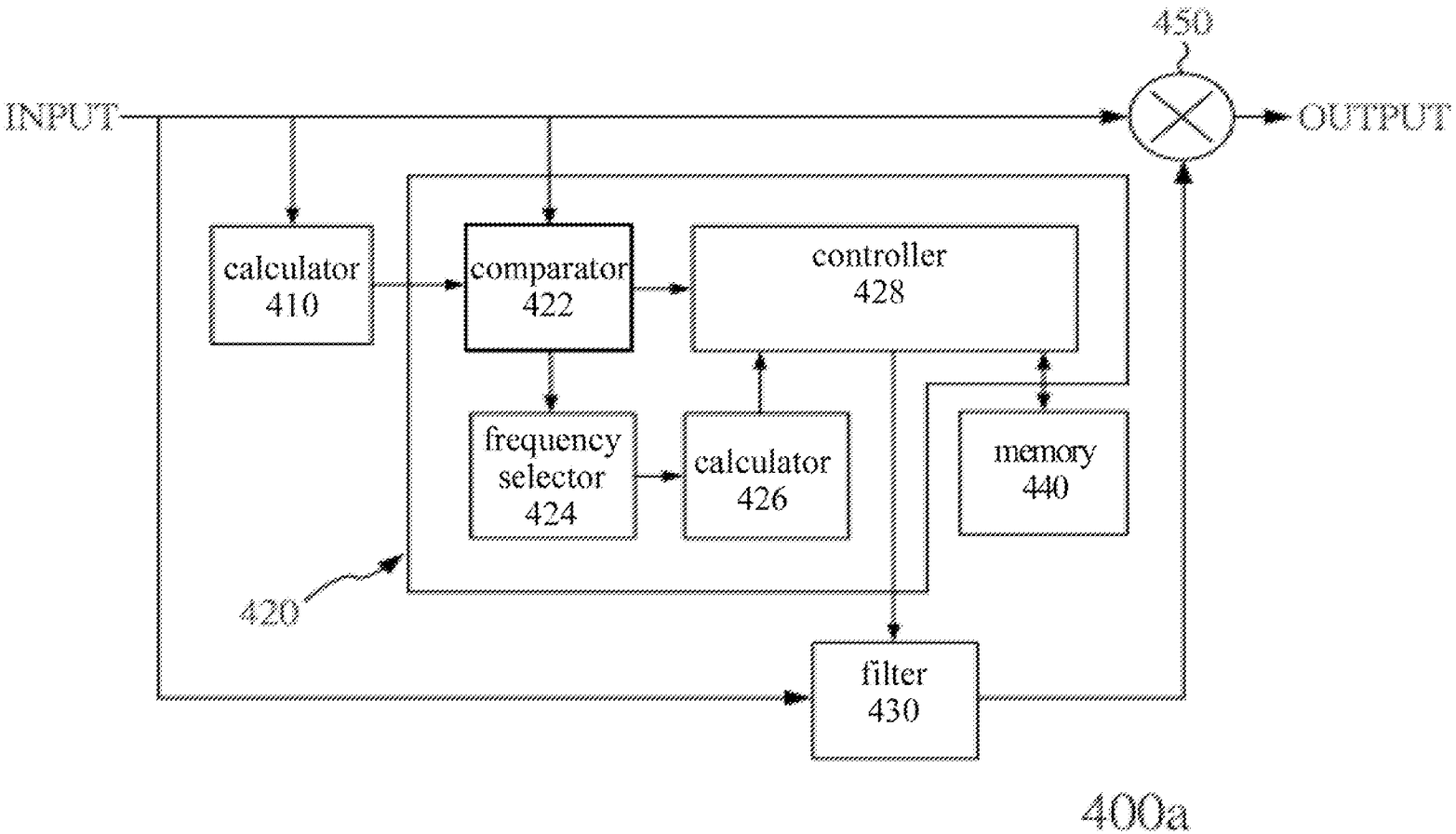
FIG. 5 is a schematic diagram showing an audio signal processing device in another embodiment.

FIG. 5 is a schematic diagram showing a device 400*a* for processing an audio signal in another embodiment. Compared with the device 400 in FIG. 4, the device 400*a* further includes a memory 440. Moreover, elements in the control unit 420 of the device 400*a* are illustrated in detail to make the operation of the control unit 420 easy to be understood.

As shown in FIG. 5, the control unit 420 includes a comparator 422, a frequency selector 424, a calculator 426 and a controller 428. The comparator 422 is coupled to the calculator 410, the frequency selector 424 and the controller 428, the calculator 426 is coupled to the frequency selector 424 and the controller 428, the controller 428 is coupled to the filter 430 and the memory 440, and the filter 430 is coupled to the logic calculator 450.

The comparator 422 compares the second harmonic sound pressure value Yp and the threshold sound pressure value Ys to generate the comparing result. When the comparing result is that the second harmonic sound pressure value Yp is larger than the threshold sound pressure value Ys, the frequency selector 424 selects a frequency of the audio signal to be adjusted. The calculator 426 calculates the sound pressure value correction Ym according to the second harmonic sound pressure value Yp and the threshold sound pressure value Ys.

Then, the controller 428 generates a control signal according to the frequency provided by the frequency selector 424 and the sound pressure value correction Ym provided by the calculator 426. After the filter 430 receives the control signal, it reduces the second harmonic sound pressure value Yp to the sound pressure value correction Ym according to the control signal. In detail, the threshold sound pressure value Ys is subtracted from the second harmonic sound pressure value Yp. The calculation of the sound pressure value correction Ym is already illustrated in the step 250 which is omitted herein to keep the specification simple.

Compared with the device 400 for processing an audio signal in FIG. 4, the device 400*a* in FIG. 5 further includes a memory 440. Thus, every time when the inputted audio signal is processed by the calculator 410 and the control unit 420, the generated comparing result or the processing result is stored in the memory 440. As a result, when the same audio signal is inputted, the control unit 420 reads the comparing result or the processing result from the memory 440 to adjust the second harmonic sound pressure value Yp, and it does not need to process the same audio signal again. Thus, the calculation steps can be skipped, and the computing resources occupied by the device 400*a* are very low, which can improve the processing efficiency of the device 400*a*.

Moreover, since the calculation steps can be skipped, the device 400*a* for processing an audio signal can provide an outputted audio signal more quickly, and the media player can play music according to the outputted audio signal more rapidly.

Although the present invention has been described in considerable detail with reference to certain preferred embodiments thereof, the disclosure is not for limiting the scope. Persons having ordinary skill in the art may make various modifications and changes without departing from the scope. Therefore, the scope of the appended claims should not be limited to the description of the preferred embodiments described above.

What is claimed is:

1. An audio signal processing method for a media player, the method comprising following steps:

generating a fundamental frequency signal;

calculating a first fundamental frequency sound pressure value and a first harmonic sound pressure value of the fundamental frequency signal;

calculating a second fundamental frequency sound pressure value and a second harmonic sound pressure value of the audio signal;

calculating a threshold sound pressure value according to the first fundamental frequency sound pressure value, the first harmonic sound pressure value, and the second fundamental frequency sound pressure value; and comparing the second harmonic sound pressure value and the threshold sound pressure value to generate a comparing result, and adjusting the second harmonic sound pressure value according to the comparing result.

2. The audio signal processing method according to claim 1, wherein the step of calculating a threshold sound pressure value according to the first fundamental frequency sound pressure value, the first harmonic sound pressure value, and the second fundamental frequency sound pressure value further comprises:

when the first fundamental frequency sound pressure value equals to the second fundamental frequency sound pressure value, calculating the threshold sound pressure value according to a ratio of the first fundamental frequency sound pressure value and the first harmonic sound pressure value.

3. The audio signal processing method according to claim 1, wherein the step of calculating a threshold sound pressure value according to the first fundamental frequency sound pressure value, the first harmonic sound pressure value, and the second fundamental frequency sound pressure value further comprises:

multiplying the second fundamental frequency sound pressure value by a ratio of the first harmonic sound pressure value and the first fundamental frequency sound pressure value to calculate the threshold sound pressure value.

4. The audio signal processing method according to claim 1, wherein the step of comparing the second harmonic sound pressure value and the threshold sound pressure value to generate a comparing result further comprises:

reducing the second harmonic sound pressure value according to the comparing result, where the comparing result is that the second harmonic sound pressure value is larger than the threshold sound pressure value.

5. The audio signal processing method according to claim 1, wherein after the step of adjusting the second harmonic sound pressure value according, to the comparing result further includes:

calculating a sound pressure value correction according to the second harmonic sound pressure value and the threshold sound pressure value; and wherein the step of comparing the second harmonic sound pressure value and the threshold sound pressure value to generate a comparing result further includes:

reducing the second harmonic sound pressure value to the sound pressure value correction according to the comparing result.

6. An audio signal processing, device comprising:

a first calculator calculating a first fundamental frequency sound pressure value and a first harmonic sound pressure value of a fundamental frequency signal, respectively, calculating a second fundamental frequency sound pressure value and a second harmonic sound pressure value of the audio signal, respectively, according to the fundamental frequency signal and the audio signal played by a media player, and calculating a threshold sound pressure value according to the first fundamental frequency sound pressure value, the first harmonic sound pressure value and the second fundamental frequency sound pressure value;

a control unit comparing the second harmonic sound pressure value and the threshold sound pressure value to generate a comparing result; and a filter adjusting the second harmonic sound pressure value according to the comparing result.

7. The audio signal processing device according to claim 6, wherein the control unit includes:

a comparator comparing the second harmonic sound pressure value and the threshold sound pressure value to generate the comparing result;

a frequency selector selecting a frequency of the audio signal to be adjusted when the comparing result is that the second harmonic sound pressure value is larger than the threshold sound pressure value;

a second calculator calculating a sound pressure value correction according to the second harmonic sound pressure value and the threshold sound pressure value; and a controller generating a control signal according to the frequency and the sound according pressure value correction;

wherein the filter reduces the second harmonic sound pressure value to the sound pressure value correction according to the control signal.

8. The audio signal processing device according to claim 6, wherein when the first fundamental frequency sound pressure value equals to the second fundamental frequency sound pressure value, the first calculator calculates the threshold sound pressure value according to a ratio of the first fundamental frequency sound pressure value and the first harmonic sound pressure value.

9. The audio signal processing device according to claim 6, wherein the first calculator multiplies the second fundamental frequency sound pressure value by a ratio of the first harmonic sound pressure value and the first fundamental frequency sound pressure value to calculate the threshold sound pressure value.

10. The audio signal processing, device according, to claim 6, wherein the audio signal processing device further includes:

a memory for storing the comparing result, wherein when the audio signal is the same, the control unit reads the comparing result in the memory to adjust the second harmonic sound pressure value.

* * * * *